US006814460B1

(12) United States Patent
Su

(10) Patent No.: US 6,814,460 B1
(45) Date of Patent: Nov. 9, 2004

(54) ORNAMENT HAVING A LIGHT EMITTING DEVICE

(76) Inventor: Chin-Lai Su, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/613,836

(22) Filed: Jul. 1, 2003

(51) Int. Cl.[7] ..... F21V 33/00

(52) U.S. Cl. ..... 362/101; 362/96; 362/276; 362/186

(58) Field of Search ..... 362/101, 96, 186, 362/276

(56) References Cited

U.S. PATENT DOCUMENTS 5,860,724 A * 1/1999 Cheng ..... 362/34
5,903,212 A * 5/1999 Rodgers ..... 340/309.8
6,416,198 B1 * 7/2002 Vanderschuit ..... 362/101

* cited by examiner

*Primary Examiner*—Alan Cariaso
*Assistant Examiner*—Mark Tsidulko

(57) ABSTRACT

An ornament includes a main body, and at least one light emitting device. The light emitting device includes a transparent cover mounted on the main body, a circuit board mounted in the transparent cover and having two connecting legs each exposed outward from the cover, and a light emitting member mounted on and connected to the circuit board. Thus, when the two connecting legs of the circuit board contact liquid, the circuit board and the light emitting member are connected and conducted, so that the light emitting member can emit blinking light outward from the cover.

7 Claims, 3 Drawing Sheets

ORNAMENT HAVING A LIGHT EMITTING DEVICE

BACKGROUND OF THE INVENTION

1. Field of the Invention

The present invention relates to an ornament, and more particularly to an ornament having a light emitting device that can emit blinking light outward simultaneously, thereby enhancing aesthetic quality of the ornament.

2. Description of the Related Art

A conventional ornament often has an outstanding configuration so as to attract the consumer's attention. However, the viewing effect of the conventional ornament lacks variation, thereby decreasing aesthetic quality of the ornament.

SUMMARY OF THE INVENTION

The primary objective of the present invention is to provide an ornament having a light emitting device.

Another objective of the present invention is to provide an ornament, wherein when the light emitting device contacts liquid, the light emitting device can emit blinking light outward simultaneously, thereby enhancing aesthetic quality of the ornament, so as to attract the consumer's attention.

A further objective of the present invention is to provide an ornament, wherein the light emitted by the light emitting member is reflected by the reflective members, thereby providing an optical variation so as to enhance the aesthetic quality of the ornament.

In accordance with the present invention, there is provided an ornament, comprising:

a main body; and at least one light emitting device mounted on the main body and including:

a transparent cover mounted on the main body;

a circuit board mounted in the transparent cover and having two connecting legs each exposed outward from the cover; and a light emitting member mounted on and connected to the circuit board;

wherein, when the two connecting legs of the circuit board contact liquid, the circuit board and the light emitting member are connected and conducted, so that the light emitting member can emit blinking light outward from the cover.

Further benefits and advantages of the present invention will become apparent after a careful reading of the detailed description with appropriate reference to the accompanying drawings.

DETAILED DESCRIPTION OF THE INVENTION

Figure 1:
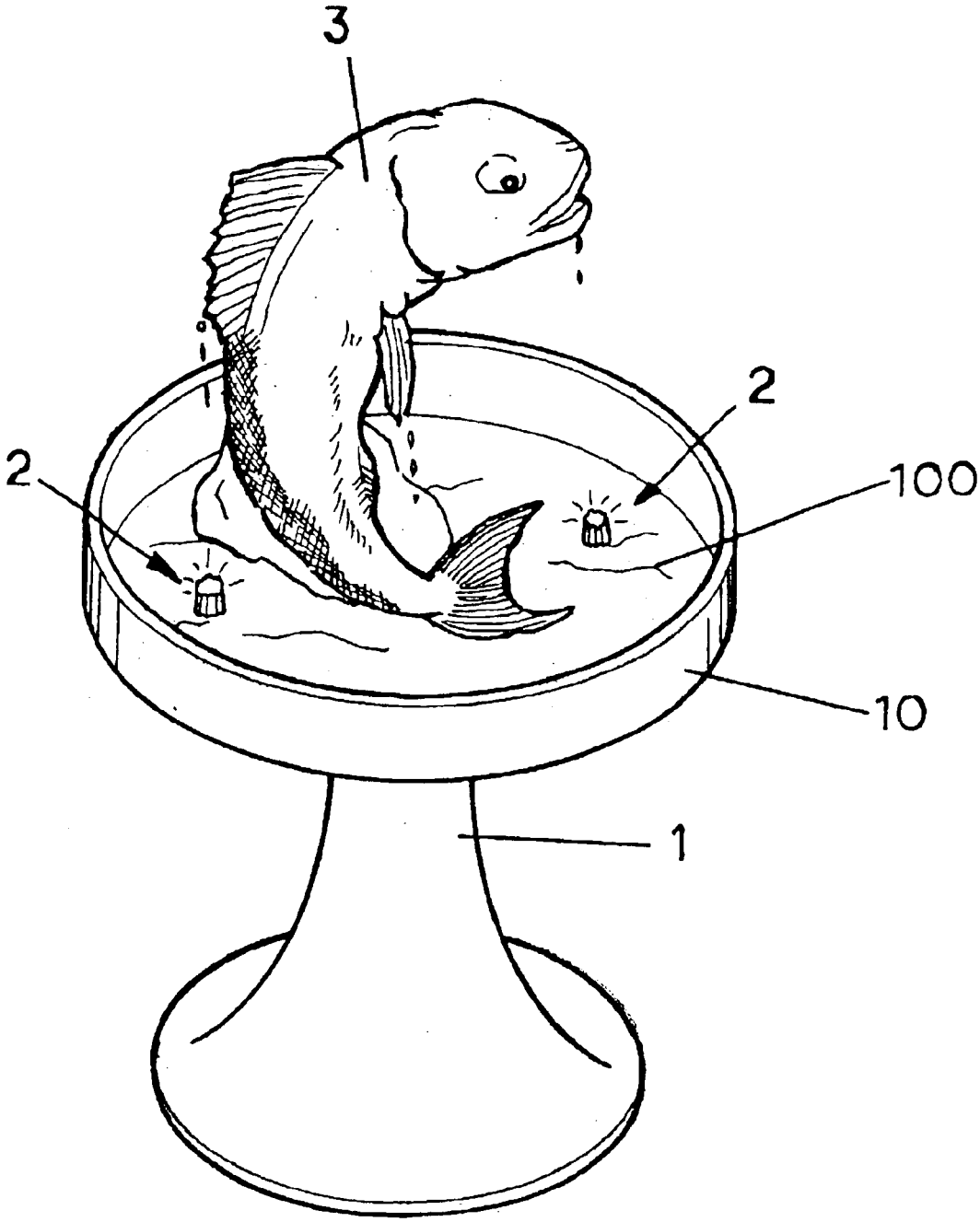
FIG. 1 is a perspective view of an ornament having a light emitting device in accordance with the preferred embodiment of the present invention.
Figure 2:
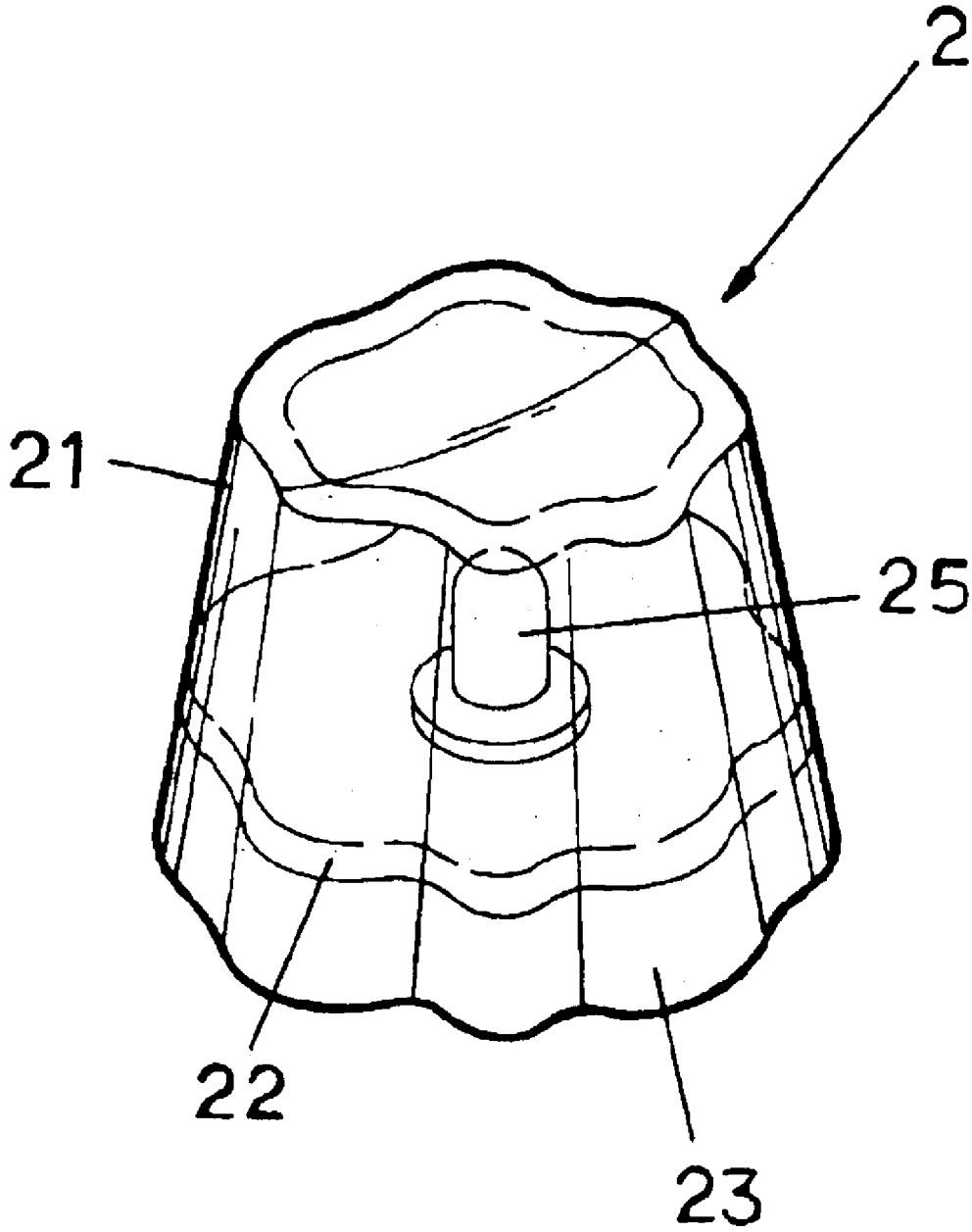
FIG. 2 is a perspective view of a light emitting device of the ornament in accordance with the preferred embodiment of the present invention.
Figure 3:
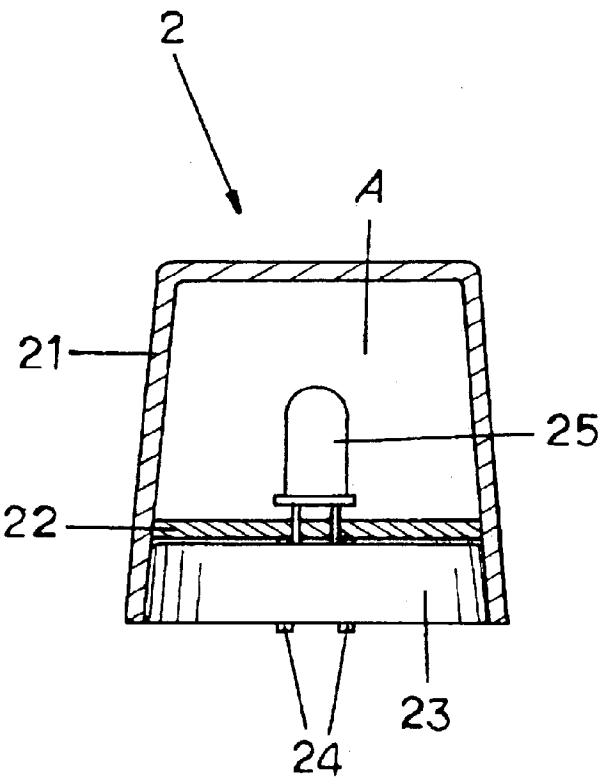
FIG. 3 is a side plan cross-sectional view of the light emitting device of the ornament as shown in FIG. 2.

Referring to the drawings and initially to FIGS. 1–3, an ornament in accordance with the. preferred embodiment of the present invention comprises a main body 1 having a top provided with an annular wall 10 formed with a receiving chamber 100, at least one light emitting device 2 mounted in the receiving chamber 100 of the main body 1, and an ice sculpture 3 mounted in the receiving chamber 100 of the main body 1.

The light emitting device 2 includes a transparent cover 21 mounted on the top of the main body 1 and having an opened bottom, a bottom plate 23 mounted in the bottom of the cover 21 and rested on the top of the main body 1, a circuit board 22 mounted in the cover 21 and rested on the bottom plate 23, and a light emitting member 25 mounted on and connected to the circuit board 22. The circuit board 22 has two connecting legs 24 each extended through the bottom plate 23 and each exposed outward from the cover 21. The light emitting member 25 is located in an inner space "A" of the cover 21.

Figure 4:
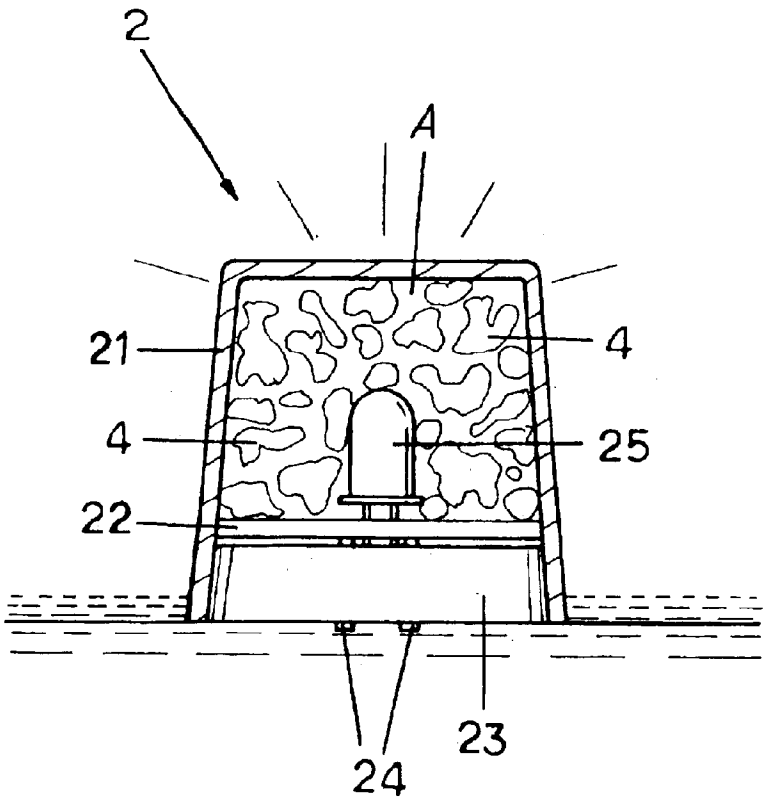
FIG. 4 is a schematic operational view of the light emitting device of the ornament as shown in FIG. 3 in use.

In operation, referring to FIGS. 3 and 4 with reference to FIGS. 1 and 2, when the ice sculpture 3 is dissolved into a liquid, the liquid flows to the top of the main body 1 to contact the light emitting device 2 so as to connect the two connecting legs 24 of the circuit board 22, thereby connecting and conducting the circuit board 22 and the light emitting member 25, so that the light emitting member 25 can emit blinking light outward from the cover 21 as shown in FIG. 4, thereby greatly enhancing aesthetic quality of the ornament.

in addition, the ornament of the present invention further comprises a plurality of reflective members 4 mounted in the inner space "A" of the cover 21, so that the light emitted by the light emitting member 25 is reflected by the reflective members 4, thereby providing an optical variation so as to enhance the aesthetic quality of the ornament.

Alternatively, the ice sculpture 3 is undefined, and the receiving chamber 100 of the main body 1 contains liquid which contacts the light emitting device 2 so as to connect the two connecting legs 24 of the circuit board 22, thereby connecting and conducting the circuit board 22 and the light emitting member 25, so that the light emitting member 25 can emit blinking light outward from the cover 21 as shown in FIG. 4, thereby greatly enhancing aesthetic quality of the ornament.

Accordingly, when the light emitting device 2 contacts the liquid, the light emitting device 2 can emit blinking light outward simultaneously, thereby greatly enhancing aesthetic quality of the ornament.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. An ornament, comprising:

a main body; and at least one light emitting device mounted on the main body and including:

a transparent cover mounted on the main body;

a circuit board mounted in the transparent cover and having two connecting legs each exposed outward from the cover; and a light emitting member mounted on and connected to the circuit board;

wherein, when the two connecting legs of the circuit board contact liquid, the circuit board and the light emitting member are connected and conducted, so that the light emitting member can emit blinking light outward from the cover; and wherein, the main body has a top provided with an annular wall formed with a receiving chamber;

the transparent cover is mounted on the top of the main body and has an opened bottom, and the light emitting device further includes a bottom plate mounted in the bottom of the cover and rested on the top of the main body; and the circuit board is rested on the bottom plate.

2. The ornament in accordance with claim 1, wherein the at least one light emitting device is mounted in the receiving chamber of the main body.

3. The ornament in accordance with claim 1, further comprising an ice sculpture mounted in the receiving chamber of the main body.

4. The ornament in accordance with claim 1, wherein each of the two connecting legs of the circuit board is extended through the bottom plate.

5. The ornament in accordance with claim 1, wherein the light emitting member is located in an inner space of the cover.

6. The ornament in accordance with claim 1, wherein the receiving chamber of the main body contains liquid therein.

7. The ornament in accordance with claim 1, further comprising a plurality of reflective members mounted in an inner space of the cover, so that the light emitted by the light emitting member is reflected by the reflective members.

* * * * *